US008798490B2

(12) United States Patent
Yanagi

(10) Patent No.: US 8,798,490 B2
(45) **Date of Patent: *Aug. 5, 2014**

(54) IMAGE FORMING APPARATUS

(75) Inventor: Yuya Yanagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/490,027

(22) Filed: Jun. 6, 2012

(65) Prior Publication Data

US 2012/0243898 A1 Sep. 27, 2012

Related U.S. Application Data

(63) Continuation of application No. 12/827,100, filed on Jun. 30, 2010, now Pat. No. 8,219,019, which is a continuation of application No. PCT/JP2010/051263, filed on Jan. 29, 2010.

(30) Foreign Application Priority Data

Jan. 30, 2009 (JP) ..... 2009-019688
Jan. 28, 2010 (JP) ..... 2010-016267

(51) Int. Cl.
*G03G 15/00* (2006.01)
*G03G 15/20* (2006.01)

(52) U.S. Cl.
CPC ..... *G03G 15/657* (2013.01); *G03G 15/2085* (2013.01); *G03G 2215/00413* (2013.01)
USPC ..... 399/68; 399/400

(58) Field of Classification Search
CPC ..... G03G 15/657; G03G 2215/00413
USPC ..... 399/68, 302, 308, 400
See application file for complete search history.

(56) References Cited

U.S. PATENT DOCUMENTS

| | | | | |
|---|---|---|---|---|
| 5,995,802 | A * | 11/1999 | Mori et al. | 399/394 |
| 6,081,680 | A * | 6/2000 | Nomura et al. | 399/159 |
| 6,389,260 | B1 * | 5/2002 | Kataoka et al. | 399/298 |
| 2004/0197111 | A1 * | 10/2004 | Kuroda | 399/66 |
| 2006/0222386 | A1 * | 10/2006 | Koshida et al. | 399/44 |
| 2006/0222394 | A1 * | 10/2006 | Koshida | 399/68 |
| 2010/0008689 | A1 * | 1/2010 | Iwasaki et al. | 399/66 |

* cited by examiner

*Primary Examiner* — Benjamin Schmitt
(74) *Attorney, Agent, or Firm* — Canon USA Inc. IP Division

(57) ABSTRACT

A loop of a transferring material is formed at a position between a secondary transfer nip portion and a fixing nip portion such that a loop amount of the loop of the transferring material, which is formed at the position between the secondary transfer nip portion and the fixing nip portion when a mono-color mode is executed, is larger than a loop amount of the loop of the transferring material, which is formed at the position between the secondary transfer nip portion and the fixing nip portion when a full-color mode is executed. In the mono-color mode, image formation is executed such that primary transfer rollers are separated from an intermediate transfer belt. In the full-color mode, image formation is executed by photosensitive drums.

11 Claims, 12 Drawing Sheets

$t_1$ ··· SHEET REAR EDGE EXITS REGISTRATION ROLLER
$t_2$ ··· FIXING SPEED CONTROL IS ON
$t_3$ ··· SHEET REAR EDGE EXITS T2 NIP PORTION
$t_4$ ··· FIXING SPEED CONTROL IS OFF

FIG. 11

| | MONO-COLOR | FULL-COLOR |
|---|---|---|
| BASIS WEIGHT ($g/m^2$) | LOOP AMOUNT (mm) | |
| ~105 | $A_1$ | $B_1$ |
| 105~120 | $A_2$ | $B_2$ |
| 120~160 | $A_3$ | $B_3$ |
| 160~ | $A_4$ | $B_4$ |

$A_1 > A_2 > A_3 > A_4$, $B_1 > B_2 > B_3 > B_4$ $A_1 > B_1$, $A_2 > B_2$, $A_3 > B_3$, $A_4 > B_4$

IMAGE FORMING APPARATUS

CROSS-REFERENCE TO RELATED APPLICATIONS

This application is a continuation of U.S. patent application Ser. No. 12/827,100 filed Jun. 30, 2010, which is a Continuation of International Application No. PCT/JP2010/051263, filed Jan. 29, 2010, which claims the benefit of Japanese Patent Application No. 2009-019688, filed Jan. 30, 2009 and No. 2010-016267 filed Jan. 28, 2010, all of which are hereby incorporated by reference herein in their entirety.

TECHNICAL FIELD

The present invention relates to an image forming apparatus that forms an image on a transferring material by an electrophotography method.

BACKGROUND ART

In recent years, increase in speed and image quality of an image forming apparatus, such as a laser printer or a copier, has been desired. Accordingly, the image forming apparatus typically employs a configuration, in which a toner image formed on an image bearing member, such as a photosensitive drum, is transferred onto an intermediate transfer member, such as a belt, and then the toner image is transferred from the intermediate transfer member onto a transferring material, such as a sheet.

A full-color machine of tandem type has been widely used as an image forming apparatus that can form a color image at a high speed with high image quality. For example, the full-color machine has a configuration in which four image forming portions of yellow (Y), magenta (M), cyan (C), and black (Bk) are arranged in parallel, and photosensitive drums of the image forming portions are in contact with an intermediate transfer belt that serves as an intermediate transfer member. Here, by using primary transfer members, the intermediate transfer belt is pressed to the photosensitive drums and hence comes into contact with the photosensitive drums.

With the image forming portions, toner images are superposed on the intermediate transfer belt, then the toner images are secondarily transferred onto a transferring material from the intermediate transfer belt, and the toner images are fixed by fixing. Thus, a full-color image is formed.

Meanwhile, the image forming apparatus that can form a full-color image has a full-color mode, in which the image forming portions of all colors are in operation while all the photosensitive drums are in contact with the intermediate transfer belt. In addition, the image forming apparatus may have a mono-color mode, in which at least one of the image forming portions (for example, black) is in operation while at least one of the photosensitive drums is separated from the intermediate transfer belt. Thus, the apparatus may have the two modes.

The apparatus has the two modes mainly to increase the life of the photosensitive drums of the image forming portions, and to decrease toner consumption. For example, in the mono-color mode in which only black is used, the photosensitive drums of the image forming portions out of operation are separated from the intermediate transfer belt and inhibited from contacting the intermediate transfer belt. Accordingly, wear of the surfaces of the photosensitive drums can be prevented, and the life of the photosensitive drums can be increased. If a blade is used for cleaning the photosensitive drum, since the rotation of the photosensitive drum is stopped, it is not necessary to use a toner for lubrication to prevent the blade to be curled. Thus, the toner consumption can be decreased.

However, in the mono-color mode, the number of the photosensitive drums being in contact with the intermediate transfer belt is smaller than that in the full-color mode. In particular, the number of support points to nip the intermediate transfer belt by the photosensitive drums and primary transfer members is small, and hence the nipping force for the intermediate transfer belt is small. As described above, in the mono-color mode in which the nipping force for the belt is small, a load that is exerted on the intermediate transfer belt may vary when a front edge of a sheet, which is a transferring material, enters a secondary transfer nip portion, which is defined by the intermediate transfer belt and the secondary transfer member, or when a rear edge of the sheet exits the secondary transfer nip portion. The variation in load may affect a driving member that drives the intermediate transfer belt, and may cause the speed of the intermediate transfer belt to vary. Consequently, density difference may occur in a toner image during the toner image is transferred at the primary transfer nip portion because of the variation in speed of the intermediate transfer belt.

Patent Literature 1 suggests a configuration in which, a pressing force of a primary transfer member to an intermediate transfer belt that is a primary transfer member, which comes into contact with an intermediate transfer belt, in a mono-color mode is larger than a pressing force in a full-color mode.

However, the number of support points for the intermediate transfer belt is not changed in the suggestion in Patent Literature 1. Hence, a certain pressing force of the primary transfer member is needed to increase a supporting force to a sufficient level. When the pressing force is excessively increased, the nip width between the primary transfer member and the intermediate transfer belt is excessively increased, likely resulting in occurrence of an image failure.

The present invention is made in light of the situations, and an object of the present invention is to provide an image forming apparatus that decreases variation in speed of an intermediate transfer belt, the variation which is generated when a transferring material exits a secondary transfer nip portion defined by a secondary transfer member and the intermediate transfer belt, and hence that can obtain an image with high image quality.

CITATION LIST

Patent Literature

PTL 1: Japanese Patent Laid-Open No. 2007-33938

SUMMARY OF INVENTION

According to the present invention, an image forming apparatus includes a rotatable intermediate transfer belt; a plurality of image bearing members arranged in a rotation direction of the intermediate transfer belt and configured to bear toner images; a plurality of primary transfer members respectively facing the plurality of image bearing members with the intermediate transfer belt interposed therebetween and being capable of defining primary transfer nip portions with the corresponding image bearing members facing the primary transfer members; a secondary transfer member configured to transfer the toner images transferred on the intermediate transfer belt by the primary transfer members, onto a transferring material at a secondary transfer nip portion; a fixing portion configured to fix the toner images transferred by the secondary transfer member, to the transferring material at a fixing nip portion; and a speed control circuit configured to control a conveying speed of the transferring material at the secondary transfer nip portion and a conveying speed of the transferring material at the fixing nip portion. A first image formation mode and a second image formation mode are executable, in the first image formation mode, image formation being performed while the image bearing members define the primary transfer nip portions with the corresponding primary transfer members respectively facing the image bearing members, in the second image formation mode, image formation being performed while at least one of the image bearing members does not define the primary transfer nip portion with the corresponding primary transfer member facing the image bearing member. The speed control circuit controls the conveying speed of the transferring material at the secondary transfer nip portion and the conveying speed of the transferring material at the fixing nip portion when the second image formation mode is executed such that a loop amount of a loop of the transferring material at a position between the secondary transfer nip portion and the fixing nip portion when the second image formation mode is executed is larger than a loop amount of a loop of the transferring material at the position between the secondary transfer nip portion and the fixing nip portion when the first image formation mode is executed.

Further features of the present invention will become apparent from the following description of exemplary embodiments with reference to the attached drawings.

BRIEF DESCRIPTION OF DRAWINGS

FIG. 11 is a table showing loop amounts according to the first embodiment.

DESCRIPTION OF EMBODIMENTS

Embodiments of image forming apparatuses according to the present invention will be described below with reference to the attached drawings.

First Embodiment

Figure 1:
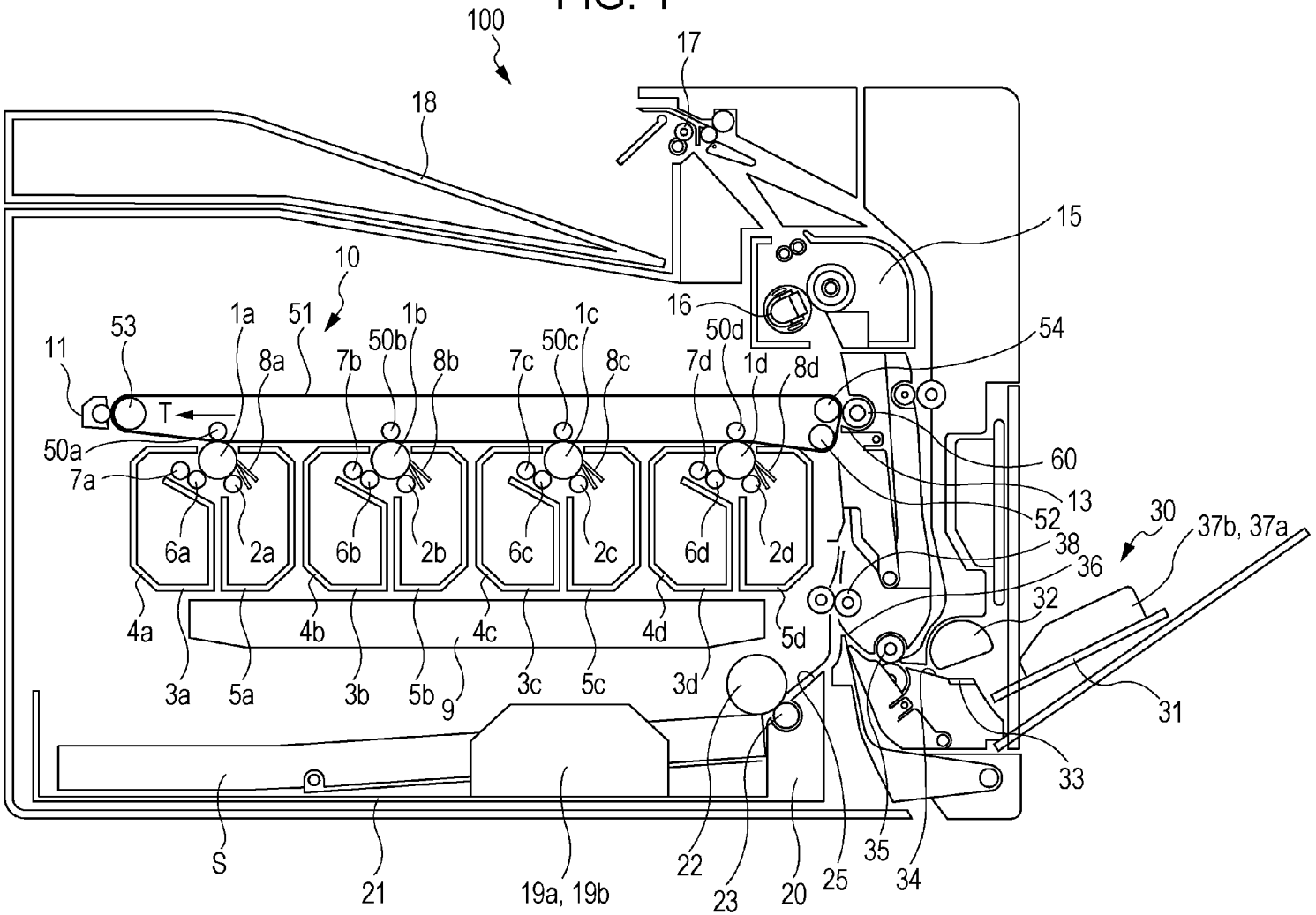
FIG. 1 is an illustration schematically showing an image forming apparatus according to the present invention.

The general configuration of an image forming apparatus will be briefly described with reference to FIG. 1. An image forming apparatus according to the present invention indicates a configuration of a color laser printer (hereinafter, referred to as printer section) 100, which is an image forming apparatus body. FIG. 1 is a vertically sectioned view showing the general configuration of the printer section 100.

The printer section 100 shown in FIG. 1 includes process cartridges 3*a*, 3*b*, 3*c*, and 3*d* that are removably attached to the apparatus body. The four process cartridges 3*a*, 3*b*, 3*c*, and 3*d* have a uniform structure, but are different from one another in that the process cartridges 3*a*, 3*b*, 3*c*, and 3*d* form images with toners of different colors, i.e., yellow (Y), magenta (M), cyan (C), and black (Bk). The process cartridges 3*a*, 3*b*, 3*c*, and 3*d* respectively include developing units 4*a*, 4*b*, 4*c*, and 4*d*, and cleaning units 5*a*, 5*b*, 5*c*, and 5*d*.

The developing units 4*a*, 4*b*, 4*c*, and 4*d* respectively include developing rollers 6*a*, 6*b*, 6*c*, and 6*d*, developer application rollers 7*a*, 7*b*, 7*c*, and 7*d*, and toner containers. The cleaning units 5*a*, 5*b*, 5*c*, and 5*d* respectively include photosensitive drums 1*a*, 1*b*, 1*c*, and 1*d*, which serve as image bearing members, charging rollers 2*a*, 2*b*, 2*c*, and 2*d*, drum cleaning blades 8*a*, 8*b*, 8*c*, and 8*d*, and waste toner containers.

A scanning unit 9 is arranged vertically below the process cartridges 3*a*, 3*b*, 3*c*, and 3*d*. The scanning unit 9 causes the photosensitive drums 1*a*, 1*b*, 1*c*, and 1*d* to be exposed to light in accordance with image signals. The photosensitive drums 1*a*, 1*b*, 1*c*, and 1*d* are charged by the charging rollers 2*a*, 2*b*, 2*c*, and 2*d* to have a predetermined negative-polarized electric potential. Then, electrostatic latent images are formed on the photosensitive drums 1*a*, 1*b*, 1*c*, and 1*d* by the scanning unit 9. The developing units 4*a*, 4*b*, 4*c*, and 4*d* cause negative-polarized toners to adhere to the electrostatic latent images. Accordingly, toner images of Y, M, C, and Bk are developed.

The intermediate transfer belt unit 10 includes a driving roller 52, a tension roller 53, a secondary transfer opposite roller 54, primary transfer rollers 50*a* to 50*d*, and an intermediate transfer belt 51. The primary transfer rollers 50*a* to 50*d* are primary transfer members. The intermediate transfer belt 51, which is an endless intermediate transfer member, is supported by the driving roller 52, the tension roller 53, and the secondary transfer opposite roller 54, which are support rollers. The intermediate transfer belt can be rotated when the driving roller 52 rotates. Further, the tension roller 53 applies a tension to the intermediate transfer belt 51 from the inside to the outside (in a direction indicated by arrow T). The primary transfer rollers 50*a*, 50*b*, 50*c*, and 50*d*, which are primary transfer members, are provided on the inner surface side of the intermediate transfer belt 51 to respectively face the photosensitive drums 1*a*, 1*b*, 1*c*, and 1*d*. Though not shown, bias applying means applies a transfer voltage to the primary transfer rollers 50*a*, 50*b*, 50*c*, and 50*d*. Each primary transfer roller and the corresponding photosensitive drum, which faces the primary transfer roller with the intermediate transfer belt interposed therebetween, may define a primary transfer nip portion. The photosensitive drums 1*a*, 1*b*, 1*c*, and 1*d*, which are image bearing members, are arranged in a rotation direction of the intermediate transfer belt 51.

The photosensitive drums 1*a* to 1*d* rotate clockwise as shown in FIG. 1, and cause the intermediate transfer belt 51 to rotate counterclockwise. When a positive-polarized transfer voltage is applied to the primary transfer rollers 50*a*, 50*b*, 50*c*, and 50*d*, the toner images formed on the photosensitive drums 1*a*, 1*b*, 1*c*, and 1*d* are primarily transferred onto the intermediate transfer belt 51 successively from the toner image on the photosensitive drum 1*a*. After the four-color toner images are superposed on the intermediate transfer belt 51, the toner images are conveyed to a secondary transfer nip portion 13.

Meanwhile, the drum cleaning blades 8*a*, 8*b*, 8*c*, and 8*d* remove the toners remaining on the surfaces of the photosensitive drums 1*a*, 1*b*, 1*c*, and 1*d* after the toner images are transferred. Also, a transfer belt cleaning device 11 removes the toners remaining on the intermediate transfer belt 51 after secondary transfer onto a sheet S, which is a transferring material. The removed toners pass through a waste toner conveyance path (not shown) and are recovered to a waste toner recovery container (not shown) arranged in a far side portion of the apparatus.

The image forming apparatus of this embodiment includes two sheet feeding devices (sheet feeding portions). A first sheet feeding portion is an apparatus body sheet feeding portion 20 provided in the printer section 100. A second sheet feeding portion is a manual sheet feeding portion 30 provided on a side surface of the printer section 100.

The apparatus body sheet feeding portion 20 includes a sheet feeding cassette 21 that is inserted to contact a positioning portion of the image forming apparatus body. In this embodiment, the sheet feeding cassette 21 contacts a front side panel (not shown) disposed on the near side in FIG. 1. A side regulation plate 19*a* on the near side in the drawing and a side regulation plate 19*b* on the far side in the drawing are attached to the sheet feeding cassette 21 movably in accordance with the size of sheets. The side regulation plates 19*a* and 19*b* perform positioning of sheets in a direction perpendicular to a conveyance direction (sheet width direction) in the sheet feeding cassette 21. With this configuration, sheets S are stacked in a positioned manner while only the upper side of the sheets S is exposed. The sheets are highly precisely positioned with respect to the image forming apparatus body.

The sheet feeding portion 20 also includes a sheet feeding roller 22 that feeds sheets S from the sheet feeding cassette 21 that houses sheets S, and a separating roller 23 that serves as separating means. The sheets S housed in the sheet feeding cassette 21 contact the sheet feeding roller 22 with a pressure, and are separated and conveyed by the separating roller 23 one by one. The separated sheet S passes through an apparatus body sheet conveyance path 25, and is conveyed to a registration roller pair 38.

The manual sheet feeding portion 30 includes a middle plate 31 on which sheets S are stacked, a sheet feeding roller 32 that feeds a top sheet S included in the sheets S on the middle plate 31, and a separating pad 33 that serves as separating means. In addition, the manual sheet feeding portion 30 includes a side regulation plate 37*a* on the near side in the drawing and a side regulation plate 37*b* on the far side in the drawing to regulate the positions in the direction perpendicular to the conveyance direction (sheet width direction). The middle plate 31 is lifted, the sheets S stacked on the middle plate 31 contact the sheet feeding roller 32 with a pressure, and the sheets S are separated and conveyed by the separating pad 33 one by one. The separated sheet S passes through a manual sheet feeding conveyance path 34, is conveyed to a sheet re-feeding roller pair 35, passes through a sheet re-feeding conveyance path 36, and is conveyed to the registration roller pair 38.

As described above, the two conveyance paths are combined in the path located upstream of the registration roller pair 38 in the printer section 100.

The registration roller pair 38 conveys the sheet S to the secondary transfer nip portion 13. The secondary transfer nip portion 13 is defined by a secondary transfer roller 60 that serves as a secondary transfer member, and the intermediate transfer belt 51. A positive-polarized transfer voltage is applied to the secondary transfer roller 60 that serves as the secondary transfer member, at the secondary transfer nip portion 13. Accordingly, the four-color toner images on the intermediate transfer belt 51 are secondarily transferred onto the conveyed sheet S.

A fixing portion includes a heating rotary member 16 and a pressure member 15. Reference sign 15 denotes an elastic pressure roller (hereinafter, referred to as pressure roller) that serves as a pressure member. The pressure roller 15 contacts the heating rotary member 16 with a pressure, and hence a fixing nip portion is defined.

The heating rotary member 16 contains a heater 90 and a thermistor 91 therein. The heater 90 generates heat at a predetermined temperature while the thermistor 91 monitors the temperature of the heater 90 (see FIG. 2A). The sheet S that bears the unfixed toner images is conveyed to the fixing nip portion, and is conveyed through the fixing nip portion while being nipped. Thus, the unfixed toner images are heated and fixed by heating. The sheet S that has passed the fixing nip portion is discharged by a sheet discharging roller 17 that is provided in a sheet discharging unit to an output tray 18.

The image forming apparatus of this embodiment can execute at least two modes including a first image formation mode and a second image formation mode and a second image formation mode.

Figure 2A:
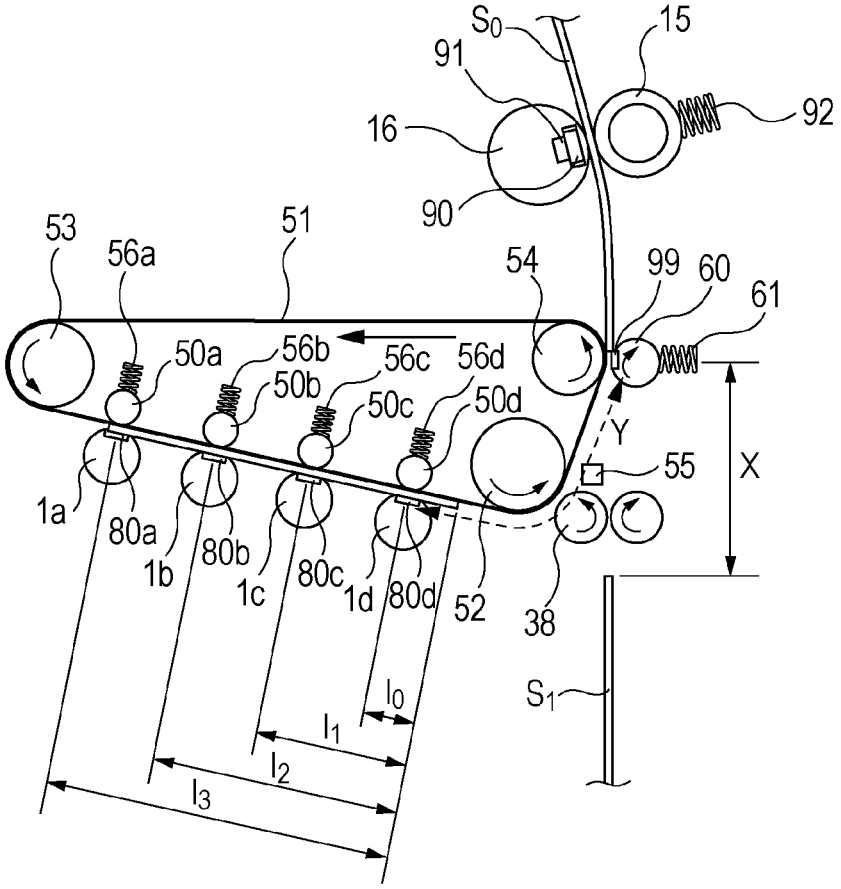
FIGS. 2A and 2B are illustrations explaining a first image formation mode, and a positional relationship between a secondary transfer nip portion and a primary transfer nip portion when the first image formation mode is executed.
Figure 2B:
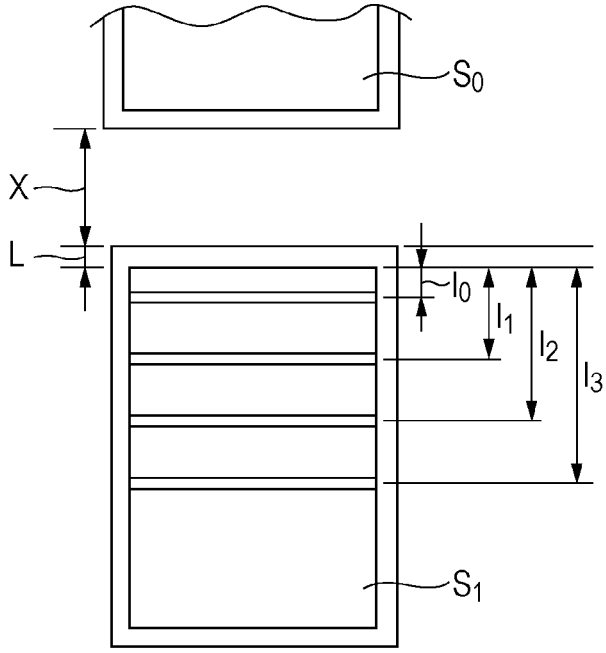

Next, FIG. 2A is a schematic view of a full-color mode which is the first image formation mode and in which images are formed on photosensitive drums of all four colors. FIG. 2B illustrates continuously printed two images in this mode. The first image formation mode is a mode in which image formation is performed while the plurality of photosensitive drums 1*a* to 1*d* and the primary transfer rollers 50*a* to 50*d* respectively define the primary transfer nip portions. Therefore, a full-color image does not have to be formed as long as all the photosensitive drums define the primary transfer nip portions. For example, the first image formation mode includes a mode in which an image of a single color is formed while all the photosensitive drums define the primary transfer nip portions.

The primary transfer rollers 50*a* to 50*d* can come into contact with or be separated from the intermediate transfer belt 51. When the primary transfer rollers 50*a* to 50*d* come into contact with the intermediate transfer belt 51, the primary transfer rollers 50*a* to 50*d* are pressed to the intermediate transfer belt 51 respectively by compression springs 56*a* to 56*d*. The primary transfer nip portions are defined by the primary transfer rollers that are pressed by the compression springs 56, and the photosensitive drums that respectively face the primary transfer rollers, with the intermediate transfer belt interposed therebetween.

The secondary transfer roller 60 can come into contact with and be separated from the intermediate transfer belt. A compression spring 61 causes the secondary transfer roller 60 to contact the intermediate transfer belt 51 and the secondary transfer opposite roller 54 with a predetermined contact pressure, and hence a secondary transfer nip portion 99 is defined.

The sheet S fed by the apparatus body sheet feeding portion 20 or the manual sheet feeding portion 30 shown in FIG. 1 is temporarily stopped at the registration roller pair 38. At this time, a thickness sensor 55, which is a thickness detecting member, detects the thickness of the sheet S. The toner images formed on the photosensitive drums 1*a* to 1*d* are successively transferred onto and superposed on the intermediate transfer belt 51 at primary transfer nip portions 80*a* to 80*d*. Then, the toner images on the intermediate transfer belt 51 are transferred onto the conveyed sheet S at the secondary transfer nip portion. The sheet S is conveyed at a timing corresponding to the toner images on the intermediate transfer belt 51. The unfixed toner images transferred onto the sheet S is fixed by heating at the fixing nip portion that is defined by the heating rotary member 16 and the pressure roller 15. Reference sign 92 denotes a fixing pressure spring. The fixing pressure spring 92 causes the pressure roller 15 to contact the heating rotary member 16 with a pressure, and hence the fixing nip portion is defined.

Figure 3A:
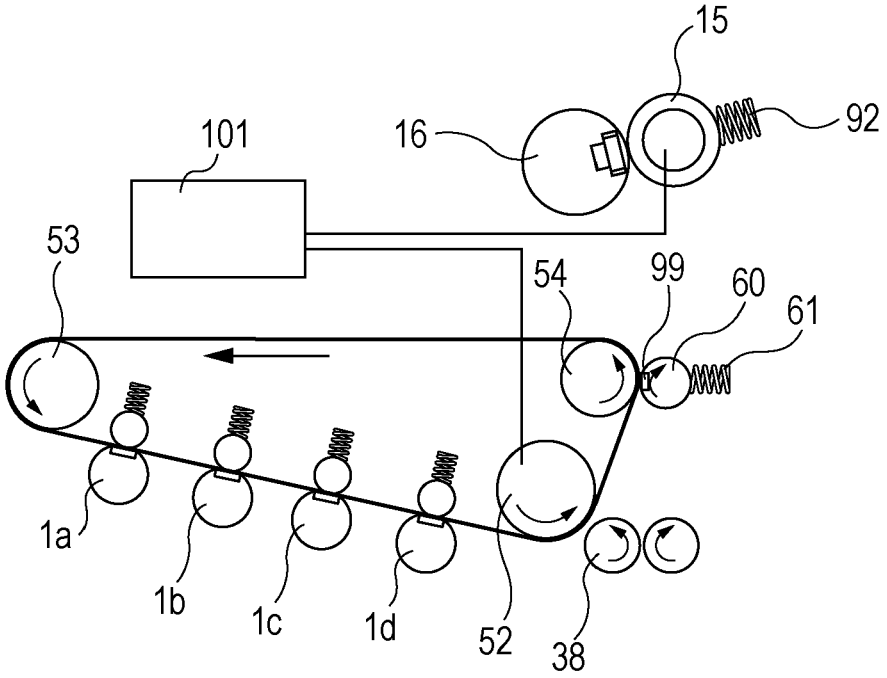
FIGS. 3A and 3B are illustrations explaining a speed control circuit and a driving portion according to the present invention.

Driving of the respective rollers and control of the fixing temperature etc. are performed by, for example, a speed control circuit 101 including a CPU, a RAM, and a ROM. In addition, referring to FIG. 3A, the speed control circuit 101 can control a rotating speed of the driving roller 52 that drives the intermediate transfer belt 51, and a rotating speed of the pressure roller 15 of the fixing portion. A plurality of the speed control circuits 101 may be provided as long as a conveying speed of a transferring material at the secondary transfer nip portion and a conveying speed of the transferring material at the fixing nip portion can be controlled.

Figure 3B:
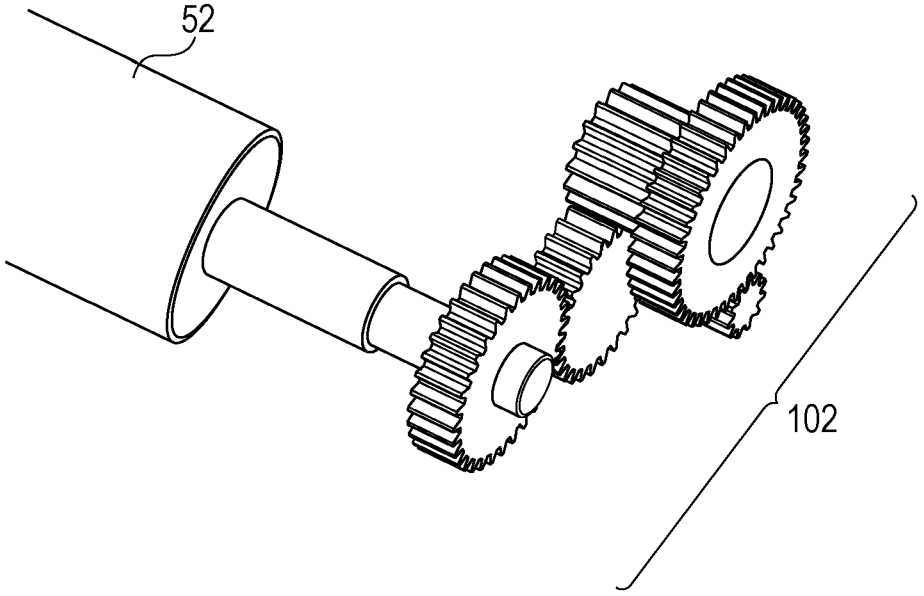

Variation in load of the intermediate transfer belt 51, the variation which occurs when a sheet $S_0$ exits the secondary transfer nip portion in FIG. 2A, will be described. FIG. 3B is a schematic view of a belt driving portion 102 that drives the driving roller 52. When the sheet $S_0$ exits the secondary transfer nip portion, a load is exerted on gears of the belt driving portion 102, and variation in speed occurs for the intermediate transfer belt 51. Owing to this, a phenomenon may occur in which toner images to be transferred onto a next sheet $S_1$ that is fed successively to the sheet $S_0$ are disordered. This phenomenon is an image failure that is called "sheet rear edge exit blur" which occurs on the next sheet $S_1$ when the rear edge of the sheet $S_0$ exits the secondary transfer nip portion.

Referring to FIG. 1, this phenomenon more likely occurs when the driving roller 52 is arranged between the primary transfer nip portion and the secondary transfer nip portion, and when the intermediate transfer belt 51 in an area for defining the primary transfer nip portion is pulled by the driving roller.

FIG. 2B is a schematic view explaining the position of first transfer onto the next sheet $S_1$ at a timing at which the rear edge of the sheet $S_0$ has exited the secondary transfer nip portion. Y (an arrow indicated by broken line in FIG. 2A) is a distance from the primary transfer nip portion 80*d* located at the most downstream side in the belt rotation direction to the secondary transfer nip portion 99 for a second or later sheet during continuous printing, and X is a distance between the sheet $S_0$ and the sheet $S_1$. Also, L is a front edge margin of the sheet $S_1$. If $Y+l_3>X+L$ is satisfied, the next sheet $S_1$ is not affected when the previous sheet $S_0$ exits the secondary transfer nip portion. However, to satisfy the condition, X has to be increased, that is, a conveyance interval between sheets has to be increased. If the conveyance interval between the sheets is increased, throughput may be largely degraded.

Figure 4A:
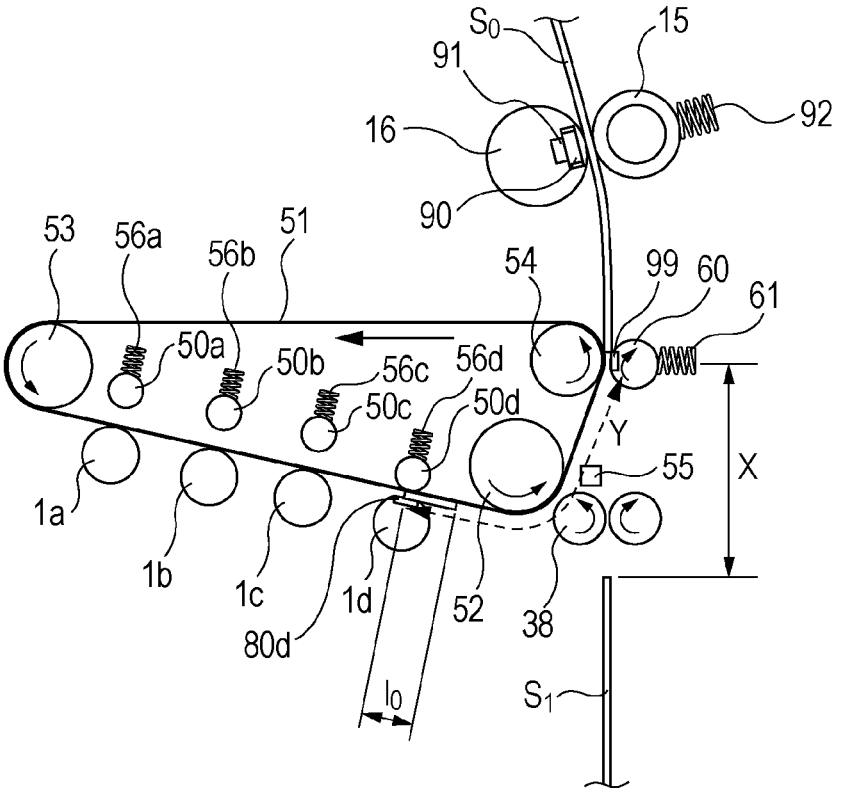
FIGS. 4A and 4B are illustrations explaining a second image formation mode, and a positional relationship between the secondary transfer nip portion and the primary transfer nip portion when the second image formation mode is executed.
Figure 4B:
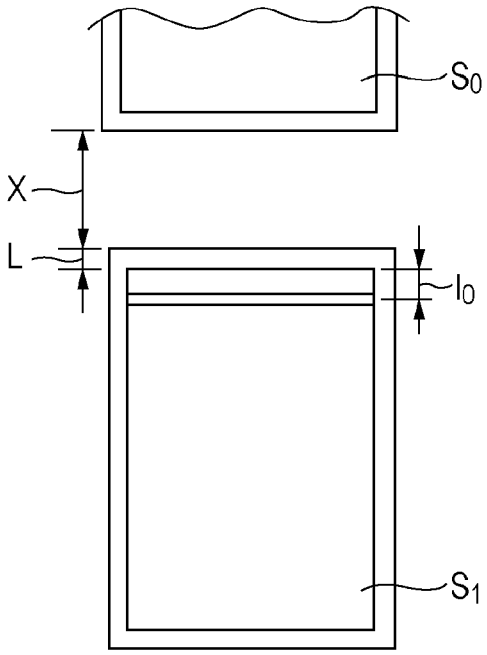

The image failure called "sheet rear edge exit blur" likely occurs when the second image formation mode is executed. In the second image formation mode, the number of support points to nip the intermediate transfer belt 51 by the primary transfer members and the photosensitive drums is small as compared with the case in the first image formation mode, and hence the effect appearing when the previous sheet $S_0$ exits the secondary transfer nip portion may be large. FIG. 4A is a schematic view of an intermediate transfer belt unit 10 in the second image formation mode, and FIG. 4B illustrates two images which are continuously printed in this mode.

The second image formation mode is a mode in which image formation is performed while at least one of the plurality of photosensitive drums 1 and the corresponding primary transfer roller do not define the primary transfer nip portion. The primary transfer roller can come into contact with and be separated from the intermediate transfer belt. When the primary transfer roller is separated from the intermediate transfer belt, a state in which the primary transfer nip portion is not defined can be provided. FIG. 4A illustrates the second image formation mode in which the primary transfer rollers 50*a* to 50*c* from among the primary transfer rollers 50*a* to 50*d* except the roller of Bk located at the most downstream side in the rotation direction of the intermediate transfer belt are separated from the intermediate transfer belt 51. FIG. 4B explains the position of the primary transfer onto the next sheet $S_1$ at a timing at which the rear edge of the sheet $S_0$ has exited the secondary transfer nip portion in the second image formation mode in FIG. 4A.

It is to be noted that the mono-color mode which is the second image formation mode described in this image forming apparatus is a case in which a single color image is formed while at least one of the plurality of photosensitive drums 1 and the corresponding primary transfer roller do not define the primary transfer nip portion. As described above, a case in which a single color image is formed while all the photosensitive drums define the primary transfer nip portions is the first image formation mode.

In the following description, it is assumed that the first image formation mode is the full-color mode, and the second image formation mode is the mono-color mode.

Figure 5A:
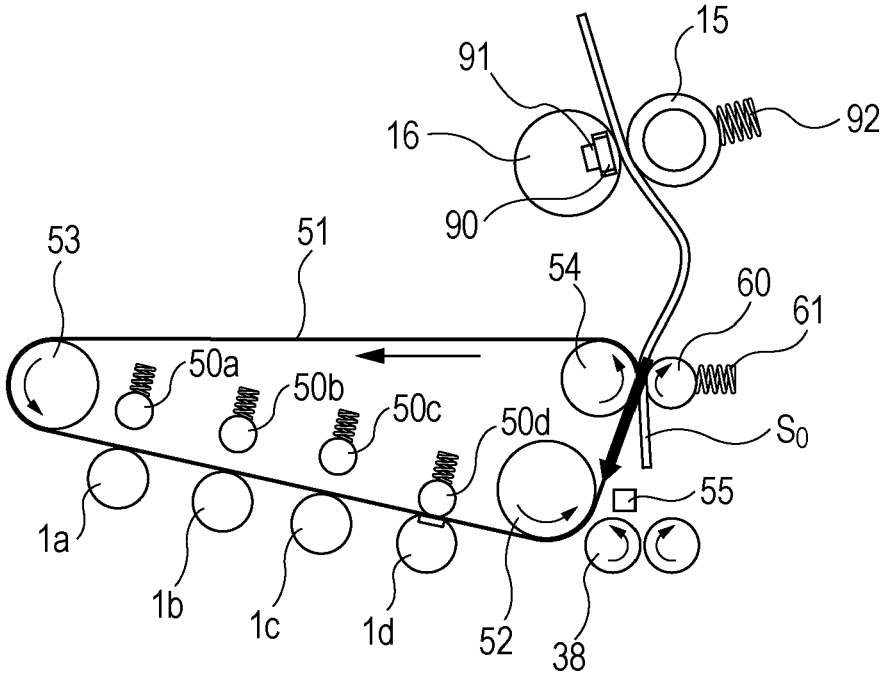
FIGS. 5A and 5B are illustrations explaining loop amounts of loops in the first image formation mode and the second image formation mode.
Figure 5B:
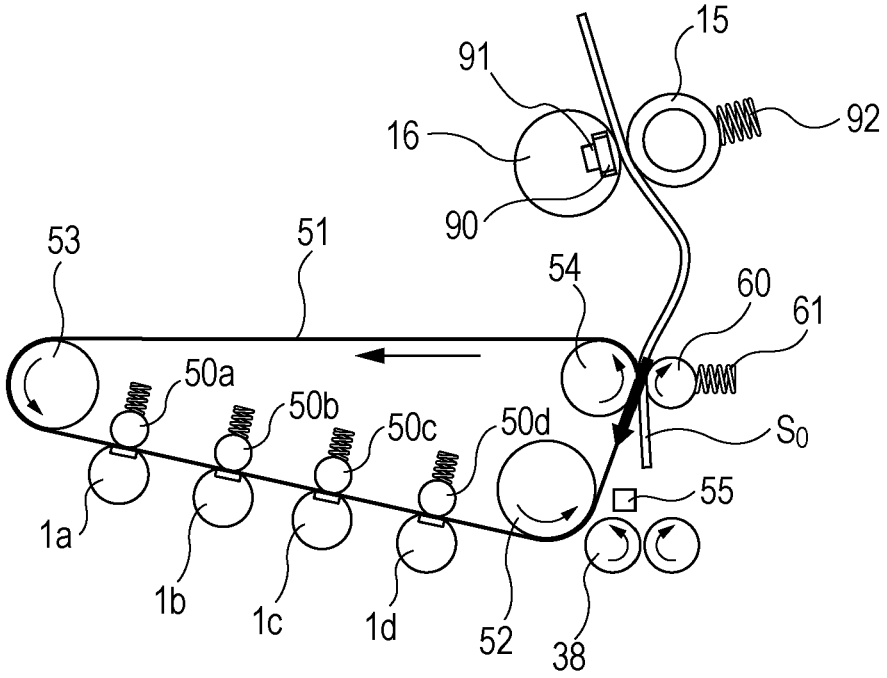

This embodiment features that, referring to FIGS. 5A and 5B, a larger loop is formed in the mono-color mode (FIG. 5A) than a loop that is formed in the full-color mode (FIG. 5B) at a position between the secondary transfer nip portion 99 and the fixing nip portion immediately before the rear edge of the sheet $S_0$ exits the secondary transfer nip portion 99.

The large loop is formed at the position between the secondary transfer nip portion (a T2 nip portion) 99 and the fixing nip portion, and a large pushing force is exerted on the intermediate transfer belt 51 by the transferring material. Thus, an image failure due to the insufficient nipping force for the intermediate transfer belt 51 is suppressed. Here, the loop is a flexure of the sheet $S_0$ with respect to a virtual straight line connecting the T2 nip portion 99 and the fixing nip portion. As a loop amount (a flexure amount) is larger, a length of the sheet $S_0$ between the T2 nip portion 99 and the fixing nip portion is larger with respect to a straight distance between the secondary transfer nip portion 99 and the fixing nip portion.

In the full-color mode, a large loop is not formed unlike the loop in the mono-color mode by the following reason. If an excessively large loop is formed in the full-color mode to correspond to the mono-color mode, a pushing force that is exerted on the intermediate transfer belt 51 may cause color shift among stations.

Thus, it is important to form loops of minimum sizes respectively in the mono-color mode and the full-color mode in accordance with the nipping force for the intermediate transfer belt 51, which can be attained by this embodiment.

Figure 6A:
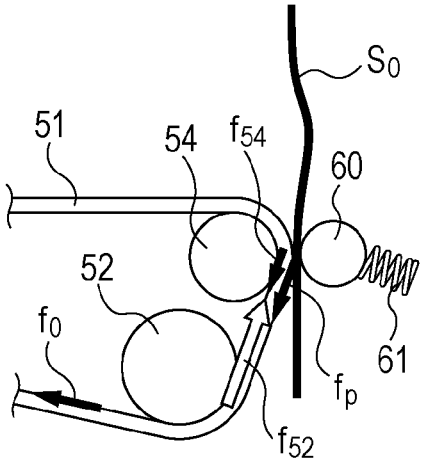
FIGS. 6A to 6D are illustrations each explaining variation in tangential force that is exerted on an intermediate transfer belt.

FIG. 6A illustrates the balance of tangential forces that are exerted on the intermediate transfer belt 51 immediately before the rear edge of the sheet $S_0$ exits the secondary transfer nip portion 99 when the loop amount is small. $f_{54}$ is a tangential force from the secondary transfer opposite roller 54 when the sheet $S_0$ is present at the secondary transfer nip portion 99, $f_p$ is a tangential force from the sheet $S_0$, and $f_{52}$ is a tangential force from the driving roller 52. Also, $f_0$ is a tangential force from other parts (the blade and the primary transfer roller, not shown).

The balance of the tangential forces that are exerted on the intermediate transfer belt 51 immediately before the rear edge of the sheet $S_0$ exits the secondary transfer nip portion 99 when the loop amount is small is expressed as follows:

$$f_{54}+f_p+f_0=f_{52} \quad (1).$$

Figure 6B:
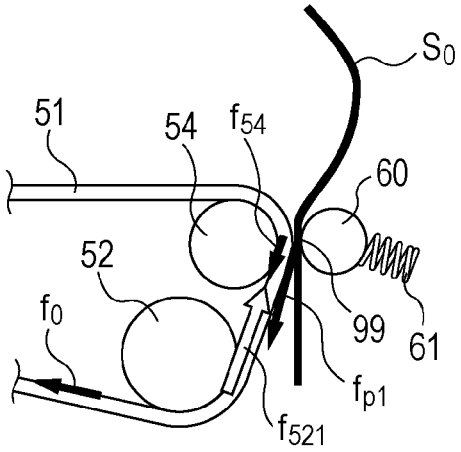

FIG. 6B illustrates the balance of tangential forces that are exerted on the intermediate transfer belt 51 immediately before the rear edge of the sheet $S_0$ exits the secondary transfer nip portion 99 when the loop amount is large. $f_{54}$ is a tangential force from the secondary transfer opposite roller 54, $f_{pl}$ is a tangential force from the sheet $S_0$, and $f_{521}$ is a tangential force from the driving roller 52. The balance of the tangential forces that are exerted on the intermediate transfer belt 51 immediately before the rear edge of the sheet $S_0$ exits the secondary transfer nip portion 99 when the loop amount is large is expressed as follows:

$$f_{54}+f_{pl}+f_0=f_{521} \quad (2).$$

As the loop of the sheet $S_0$ is larger, the pushing force exerted on the intermediate transfer belt 51 from the sheet $S_0$ is larger. Thus, a magnitude relation is established as follows:

$$f_{pl}>f_p \quad (3).$$

With the expressions (1), (2), and (3), a magnitude relation is established as follows for the tangential force on the intermediate transfer belt 51 from the driving roller 52:

$$f_{521}>f_{52} \quad (4).$$

Although the loop amounts are the same, as the thickness of the sheet $S_0$ is smaller, the pushing force on the intermediate transfer belt 51 from the transferring material is smaller. Therefore, to obtain a pushing force required for improving the sheet rear edge blur, the loop amount has to be increased if the thickness of the sheet $S_0$ is small.

Figure 6C:
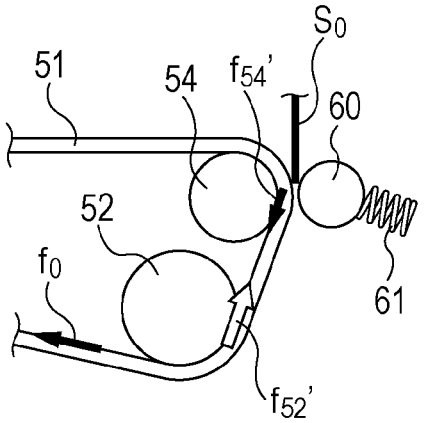

FIG. 6C illustrates a moment when the rear edge of the sheet $S_0$ has exited the secondary transfer nip portion 99. At this moment, the sheet $S_0$ and the secondary transfer roller 60 are separated from the intermediate transfer belt 51. $f_{54}'$ is a tangential force on the intermediate transfer belt 51 from the secondary transfer opposite roller 54, and $f_{52}'$ is a tangential force from the driving roller 52. The balance of the tangential forces that are exerted on the intermediate transfer belt 51 at the moment when the rear edge of the sheet $S_0$ exits the secondary transfer nip portion 99 is expressed as follows:

$$f_{54}'+f_0=f_{52}' \quad (5).$$

Regarding the tangential force on the intermediate transfer belt 51 from the secondary transfer opposite roller 54, when $f_{54}'$ at the moment when the rear edge of the sheet has exited the secondary transfer nip portion 99 and $f_{54}$ during the secondary transfer are compared with one another, the force during the secondary transfer additionally has a sliding load of a bearing (not shown) of the secondary transfer opposite roller 54. Thus, a magnitude relation is established as follows:

$$f_{54}>f_{54}' \quad (6).$$

With the expressions (1), (5), and (6), a magnitude relation is established as follows for the tangential force on the intermediate transfer belt 51 from the driving roller 52:

$$f_{521}>f_{52}>f_{52}' \quad (7).$$

Figure 6D:
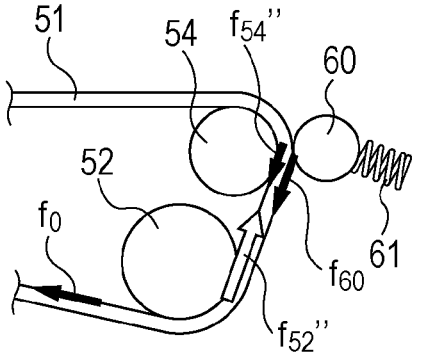

Next, FIG. 6D illustrates a case in which the sheet $S_0$ is not present at the T2 nip portion 99, and the secondary transfer roller 60 contacts the intermediate transfer belt 51 with a pressure. Herein, $f_{60}$ is a tangential force on the intermediate transfer belt 51 from the secondary transfer roller 60, $f_{54}''$ is a tangential force from the secondary transfer opposite roller 54, and $f_{52}''$ is a tangential force from the driving roller 52. When the sheet $S_0$ is not present at the secondary transfer nip portion 99 and the secondary transfer roller 60 contacts the intermediate transfer belt 51 with a pressure, the balance of the tangential forces that are exerted on the intermediate transfer belt 51 is expressed as follows:

$$f_{54}''+f_{60}+f_0=f_{52}'' \quad (8).$$

Herein, the compression spring 61 has a smaller urging force when the sheet $S_0$ is not present at the secondary transfer nip portion 99 and the secondary transfer roller 60 contacts the intermediate transfer belt 51 with a pressure, than an urging force when the sheet $S_0$ is present at the secondary transfer nip portion 99. The tangential force from the secondary transfer roller 60 when the sheet $S_0$ is not present at the secondary transfer nip portion 99 is smaller than the tangential force when the sheet $S_0$ is present at the secondary transfer nip portion 99. Thus, a magnitude relation is established as follows:

$$f_p>f_{60} \quad (9).$$

Regarding the tangential force on the intermediate transfer belt 51 from the secondary transfer opposite roller 54, when $f_{54}''$ in the case in which the sheet $S_0$ is not present at the secondary transfer nip portion 99 and the secondary transfer roller 60 contacts the intermediate transfer belt 51 with a pressure and $f_{54}'$ at the moment when the rear edge of the sheet has exited the secondary transfer nip portion 99 are compared with one another, the following relation is established. In particular, $f_{54}''$ when the secondary transfer roller 60 contacts the intermediate transfer belt 51 with a pressure is larger because a sliding load of the bearing (not shown) of the secondary transfer opposite roller 54 is added. Thus, a magnitude relation is established as follows:

$$f_{54}''>f_{54}' \quad (10).$$

Regarding the tangential force on the intermediate transfer belt 51 from the secondary transfer opposite roller 54, if $f_{54}$ when the sheet $S_0$ is present at the T2 nip portion 99, and $f_{54}''$ when the sheet $S_0$ is not present at the secondary transfer nip portion 99 and the secondary transfer roller 60 contacts the intermediate transfer belt 51 with a pressure are compared with one another, $f_{54}''$ has the following relation. In particular, $f_{54}$ when the sheet $S_0$ is present at the secondary transfer nip portion 99 is larger because a sliding load of the bearing (not shown) of the secondary transfer opposite roller 54 is added. Thus, by combining the expression (10), a magnitude relation is established as follows:

$$f_{54}>f_{54}''>f_{54}' \quad (11).$$

With the expressions (5), (8), and (11), a magnitude relation is established as follows for a tangential force on the intermediate transfer belt 51 from the driving roller 52:

$$f_{52}''>f_{52}' \quad (12).$$

By combining the expressions (1), (8), (9), (11), and (12), a magnitude relation is established as follows for a tangential force from the driving roller 52:

$$f_{521}>f_{52}>f_{52}''f_{52}' \quad (13).$$

Figure 7:
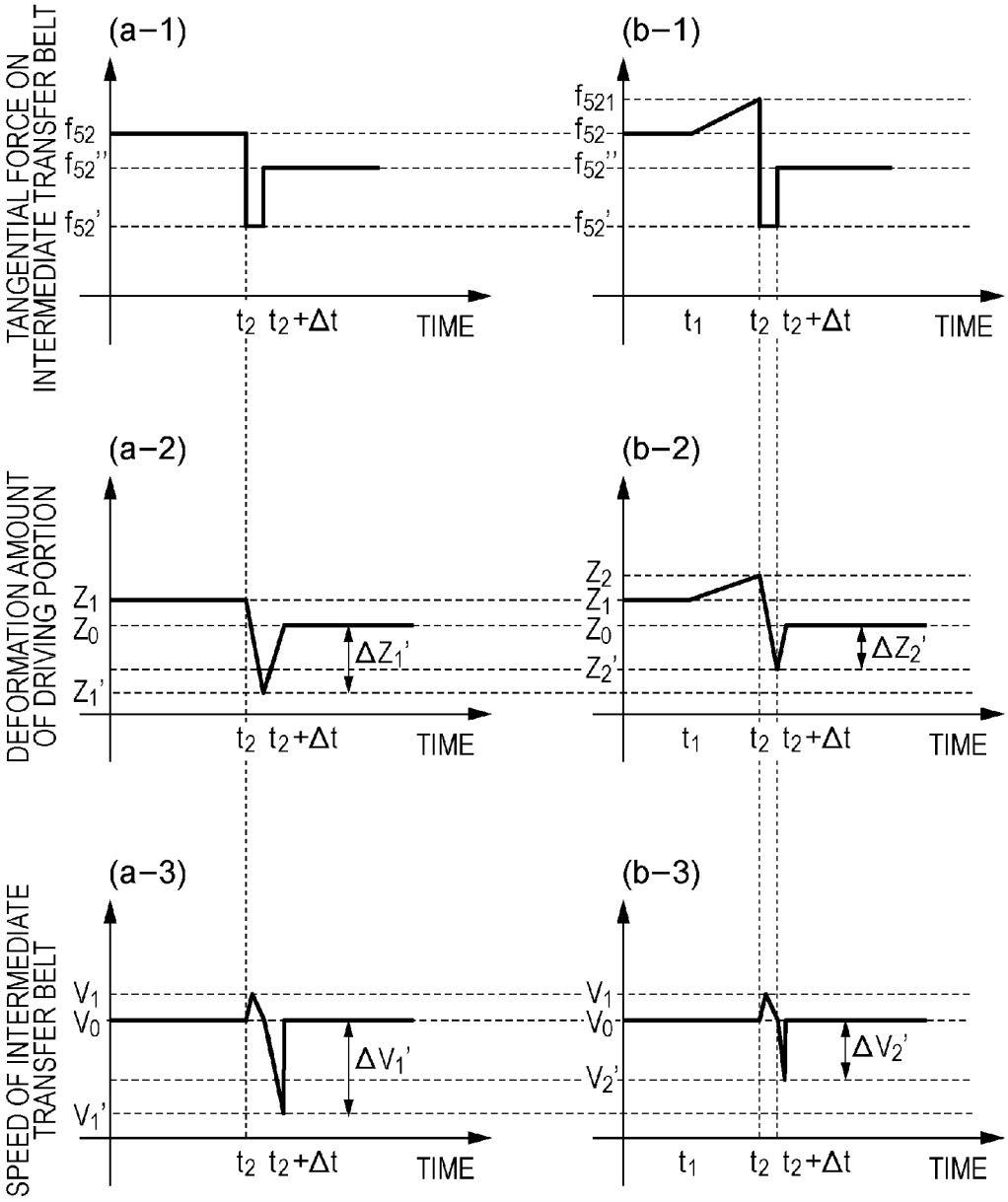
FIG. 7 is illustrations explaining a relationship among a tangential force that is exerted on the intermediate transfer belt, a deformation amount of a driving member, and a speed of the intermediate transfer belt.

FIG. 7 illustrates a change with time for a tangential force that is exerted on the intermediate transfer belt 51 immediately before the rear edge of the sheet $S_0$ exits to immediately after that. (a-1) is a case with a small loop amount, and (b-1) is a case with a large loop amount. Also, a change with time for a deformation amount of the driving member (not shown) of the intermediate transfer belt 51 is shown. (a-2) is a case with a small loop amount, and (b-2) is a case with a large loop amount. Further, a change with time for a speed of the intermediate transfer belt 51 is shown. (a-3) is a case with a small loop amount, and (b-3) is a case with a large loop amount.

Herein, a driving load of the driving roller 52 is larger as a tangential force on the intermediate transfer belt 51 from the driving roller 52 expressed by the expression (13) is larger, and a deformation amount of a gear that is the driving member defining the driving portion 102 is proportional to the tangential force. The gear serving as the driving member is deformed as far as the deformation does not exceed the limit of elasticity. Also, $\Delta t$ is a period of time after the rear edge of the sheet $S_0$ exits the secondary transfer nip portion 99, and while the intermediate transfer belt 51 does not contact the sheet $S_0$ or the secondary transfer roller 60.

When the loop amount is increased, the increase in loop amount is started at a time $t_1$ indicated in (b-1) and (b-2) in FIG. 7, so that the loop amount reaches a required loop amount until a time $t_2$ at which the rear edge of the sheet $S_0$ exits the secondary transfer nip portion 99.

As described above, at the timing immediately before the time $t_2$ at which the rear edge of the sheet $S_0$ exits the secondary transfer nip portion 99, the tangential force that is exerted on the intermediate transfer belt 51 is larger when the loop amount is increased by a difference of the pushing force by the transferring material, as compared with the case when the loop amount is small ($f_{521}>f_{52}$). However, during a period from the time $t_2$ at which the rear edge of the sheet $S_0$ exits the secondary transfer nip portion 99 to the end of $\Delta t$, the tangential force is instantaneously decreased to the same tangential force $f_{52}'$. Meanwhile, the deformation amount for the driving member of the intermediate transfer belt 51 immediately before the rear edge of the sheet $S_0$ exits the secondary transfer nip portion 99 is proportional to the tangential force that is exerted on the intermediate transfer belt 51. Thus, when $Z_2$ is an absolute deformation amount of the gear when the loop amount is large, and $Z_1$ is an absolute deformation amount of the gear when the loop amount is small, $Z_2>Z_1$ is established.

As shown in (a-1) and (b-1) in FIG. 7, the tangential force ($f_{52}'$) that is exerted on the intermediate transfer belt is rapidly decreased until the rear edge of the sheet S has exited the secondary transfer nip portion 99 and the period of time $\Delta t$ has elapsed. When the tangential force on the intermediate transfer belt is decreased, the absolute deformation amount of the gear is decreased because the load to the gear is decreased.

At a time $t_2+\Delta t$ at which the increase in tangential force is started again, $Z_2'$ is an absolute deformation amount of the gear when the loop amount is large, and $Z_1'$ is an absolute deformation amount of the gear when the loop amount is small. Then, the deformation amounts of the gear from $t_2$ to $t_2+\Delta t$ are substantially equivalent, and $Z_1-Z_1'=Z_2-Z_2'$ is established. Hence, $Z_2'>Z_1'$ is established.

Then, referring to (a-2) and (b-2) in FIG. 7, the absolute amounts of the gear are converged to $Z_0$. Referring to (a-3) and (b-3) in FIG. 7, the rotating speed of the intermediate transfer belt 51 is converged to a speed $V_0$ until the rear edge of the sheet $S_0$ has exited the secondary transfer nip portion 99, in either case when the loop amount is large and the loop amount is small. When the rear edge of the sheet S has exited the secondary transfer nip portion 99, the speed of the intermediate transfer belt 51 is changed. After the change in speed occurs, the rotating speed of the intermediate transfer belt 51 is converged again to the speed $V_0$.

Thus, the change in rotating speed of the intermediate transfer belt 51 can be considered as follows. In a period until the absolute deformation amount of the gear that is the driving member is converged again to $Z_0$, a force is not transmitted from the driving portion 102 defined by the gear to the driving roller 52. With this effect, the speed of the intermediate transfer belt 51 may be decreased. Therefore, as the deformation amount of the gear until the absolute deformation amount is converged again to $Z_0$ is larger, the period of time in which the force is not transmitted from the driving portion 102 defined by the gear to the driving roller 52 is increased.

$\Delta Z_2'$ is a deformation amount of the driving member from when the rear edge of the sheet $S_0$ has exited the secondary transfer nip portion 99 and the deformation amount of the driving member is maximally decreased until when the increase in deformation amount is started again, in the case with the large loop amount. $\Delta Z_1'$ is a deformation amount of the gear in the case with the small loop amount.

Then, the relationship between the deformation amounts becomes $\Delta Z_2'<\tau Z_1'$. Referring to (a-3) and (b-3) in FIG. 7, $\Delta V_1'$ is a speed decrease amount when the deformation amount is $\Delta Z_1'$, and $\Delta V_2'$ is a speed decrease amount when the deformation amount is $\Delta Z_2'$. Regarding the relation of $\Delta Z_2'<\Delta Z_1'$, a relation for a speed change amount is $\Delta V_2'<\Delta V_1'$.

Figure 8:
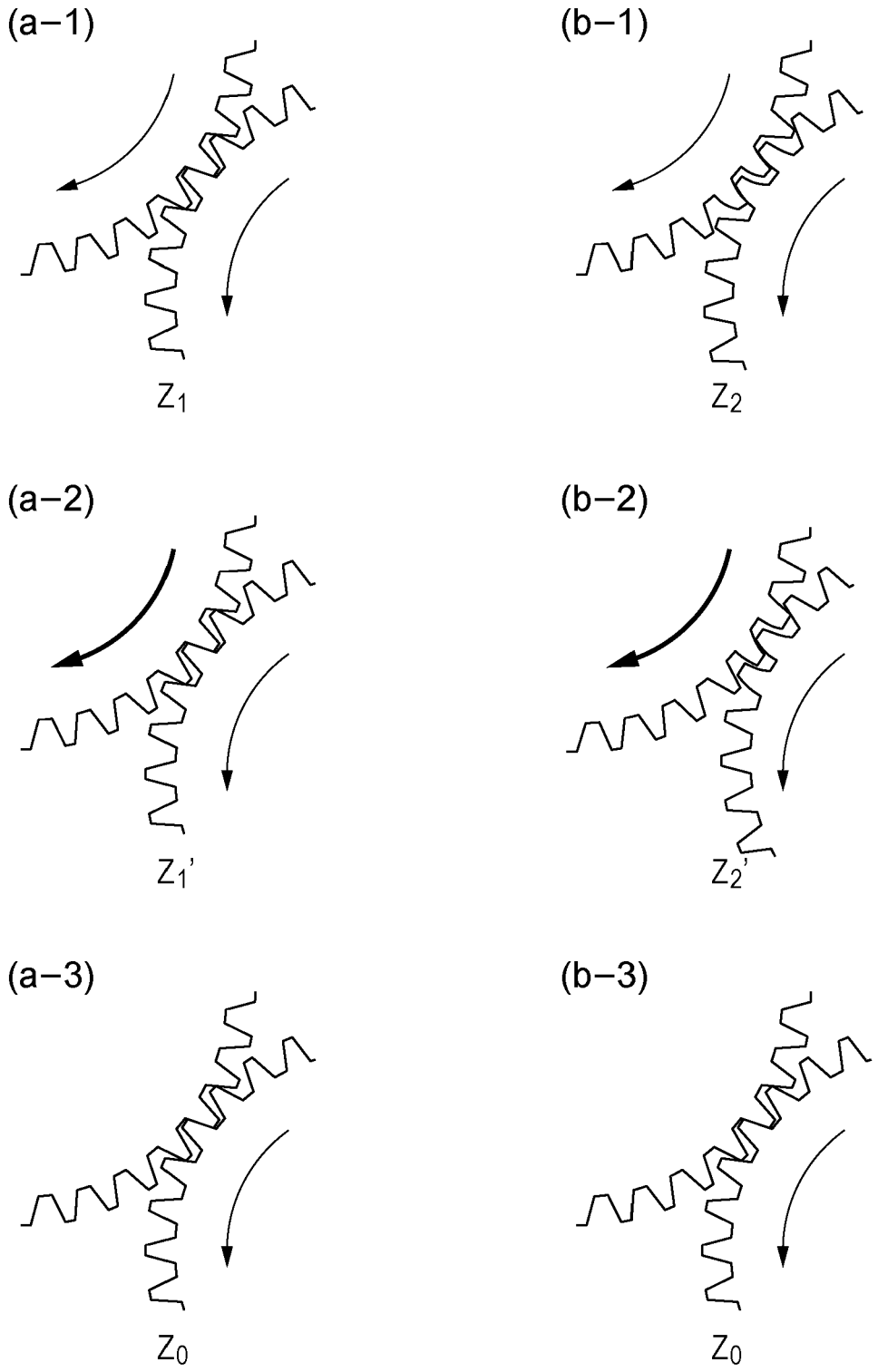
FIG. 8 is illustrations each explaining deformation progress of the driving member.

Accordingly, the deformation amount of the driving member is small when the loop amount is large. Hence, the decrease in speed of the intermediate transfer belt 51 is small. FIG. 8 is schematic views each showing deformation progress of the gear that is the driving member. In FIG. 8, (a-1), (a-2), and (a-3) show deformation progress of the gear when the loop amount is small, and (b-1), (b-2), and (b-3) show deformation progress of the gear when the loop amount is large. When (a-1) and (b-1) in FIG. 8, which represent a state of the gear before the rear edge of the sheet $S_0$ exits, are compared with one another, the gear with a large loop amount is more deformed. When (a-2) and (b-2) in FIG. 8, which represent a state in which the rear edge of the sheet $S_0$ has exited and the speed of the intermediate transfer belt 51 has been decreased, are compared with one another, the gear with a large loop amount in (b-2) is more deformed. When (a-3) and (b-3) in FIG. 8, which represent a state of the gear in which the rotating speed of the intermediate transfer belt 51 has been converged again to the speed $V_0$, are compared with one another, the gear is deformed by a substantially equivalent amount.

Thus, by increasing the loop amount immediately before the rear edge of the sheet $S_0$ exits the secondary transfer nip portion, and by causing the rear edge of the sheet $S_0$ to exit the secondary transfer nip portion while the pushing force is exerted on the intermediate transfer belt 51, the decrease in speed of the intermediate transfer belt 51 due to the variation in load can be decreased. Accordingly, appearance of an image failure can be suppressed.

Meanwhile, in a method of suppressing deformation of a gear by using a gear made of metal, an image failure such as shift of scanning line intervals, which occurs when the rigidity of the gear is increased, may likely occur. By using a gear made of resin and not having high rigidity as the driving member, an image failure such as the shift of scanning line intervals can be suppressed.

Figure 9:
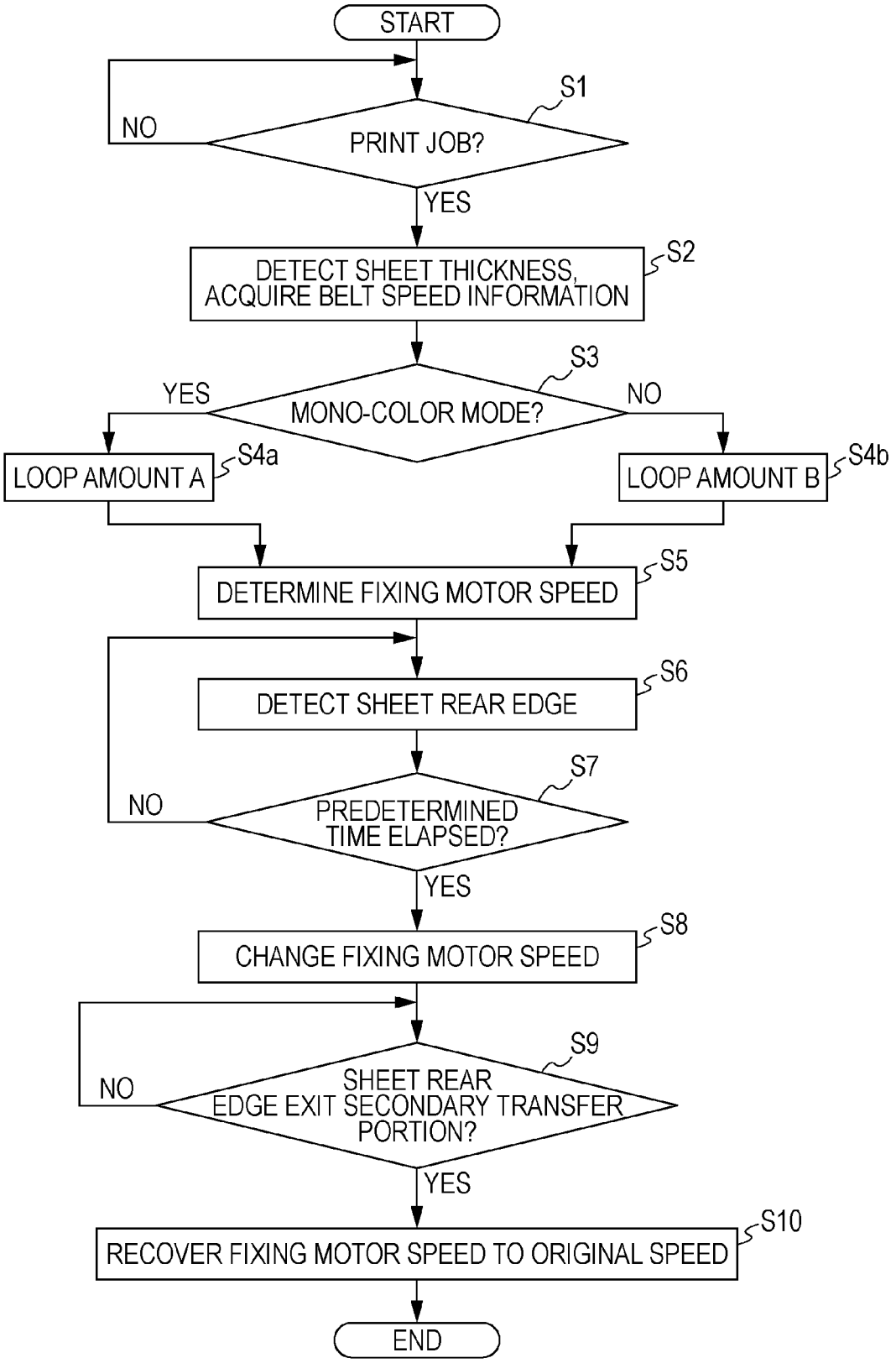
FIG. 9 is a flowchart showing a loop formation sequence according to a first embodiment.

Next, a sequence, in which a loop is formed for the transferring material at a position between the secondary transfer nip portion and the fixing nip portion, will be described. FIGS. 9 and 10(*a*) are respectively a flowchart for the loop formation sequence, and a graph showing a change in speed with time of a fixing motor (not shown). In this embodiment, the loop is formed such that the speed control circuit 101 controls the fixing motor speed relative to the speed of the intermediate transfer belt. In particular, the loop is formed such that the speed control circuit 101 relatively controls the rotating speed of the intermediate transfer belt and the rotating speed of the fixing motor. For example, the rotating speed of the intermediate transfer belt may be changed relative to the rotating speed of the fixing motor. If the fixing motor speed is decreased relative to the speed of the intermediate transfer belt, the loop amount to be formed may be larger than that when the fixing motor speed is equivalent to the speed of the intermediate transfer belt. In this embodiment, the speed control circuit 101 performs control such that the fixing motor speed relative to the speed of the intermediate transfer belt in the mono-color mode is lower than the fixing motor speed relative to the speed of the intermediate transfer belt in the full-color mode. Thus, a large loop amount can be provided.

First, the CPU in the control portion (not shown) determines the presence of a print job (in step S1, hereinafter, a step number is referred to like S1). If the CPU determines that the print job is "present" (S1, Yes), the thickness sensor 55 detects the thickness of a sheet, and the CPU acquires information of the speed of the intermediate transfer belt (belt speed) and the fixing motor speed ($N_1$) (S2). Next, the CPU determines whether the state of the image forming apparatus is the mono-color mode (S3).

Herein, the mono-color mode and the full-color mode respectively have different loop amount tables for respective thicknesses of sheets (for example, evaluated by using basis weight) as shown in FIG. 11. The loop amount tables shown in FIG. 11 are stored in the ROM included in a control portion (not shown). The CPU refers the loop amount tables, to obtain information relating to the loop amount corresponding to the sheet detected by the thickness sensor 55 that is a thickness detecting member.

First, the basis weight (g/m$^2$) of sheets is classified into predetermined ranges of 105 g/m$^2$ or smaller, 105 to 120 g/m$^2$, 120 to 160 g/m$^2$, and 160 g/m$^2$ or larger. Loop amounts in the mono-color mode are $A_1$, $A_2$, $A_3$, and $A_4$. Loop amounts in the full-color mode are $B_1$, $B_2$, $B_3$, and $B_4$. As described above, since a larger loop is required in the mono-color mode than that in the full-color mode, $A_1>B_1$, $A_2>B_2$, $A_3>B_3$, and $A_4>B_4$ are satisfied. Also, as the thickness (basis weight) of a sheet is smaller, the rigidity of a transferring material is low. Thus, a larger loop has to be provided to obtain a required pushing force. Thus, relations of $A_1>A_2>A_3>A_4$, and $B_1>B_2>B_3>B_4$ are established.

By referring the loop amount tables, in the mono-color mode (S3, Yes), a loop amount A is selected (S4*a*), and in the full-color mode (S3, No), a loop amount B is selected (S4*b*). Then, the speed control circuit 101 determines the fixing motor speed to a fixing motor speed ($N=N_1$) shown in the graph in FIG. 10A (S5).

Next, a sheet position sensor (not shown) located near the registration roller pair 38 detects the rear edge of a sheet (S6). After a predetermined time has elapsed (S7, Yes), the speed control circuit 101 changes the fixing motor speed from $N_1$ to $N_2$ (S8). That is, the control by the speed control circuit is ended after the rear edge of the transferring material exits the secondary transfer nip portion.

Figure 10A:
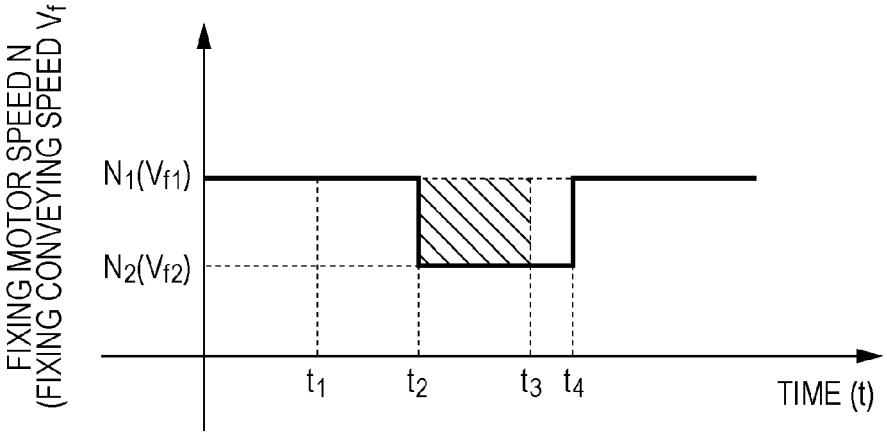
FIGS. 10A and 10B are illustrations each showing a change in fixing motor speed with time in the loop formation sequence according to the first embodiment.

Herein, a time $t_1$ in FIG. 10A is a time at which the sheet position sensor near the registration roller pair 38 has detected the rear edge of the sheet. Also, a time $t_2$ in FIG. 10A is a time at which the sheet position sensor has detected the rear edge of the sheet and a predetermined time has elapsed, at which the fixing motor speed has been changed from $N_1$ to $N_2$, and at which the fixing speed control according to this embodiment has been started (turned ON). With reference to the registration roller pair 38, a predetermined loop amount can be provided regardless of the size of a transferring material.

When the rear edge of the sheet has exited the secondary transfer nip portion (S9, Yes), the speed control circuit 101 recovers the fixing motor speed to the original speed, that is, from $N_2$ to $N_1$ (S10). Herein, a time $t_3$ in FIG. 10A is a time at which the rear edge of the sheet has exited the T2 nip portion, and a time $t_4$ is a time after the time $t_3$. The speed control circuit 101 recovers the fixing motor speed to the original speed, i.e., the speed control circuit 101 recovers the fixing motor speed from $N_2$ to $N_1$, at the time $t_4$. In FIG. 10A, when $V_{f1}$ is a conveying speed (fixing conveying speed) of the transferring material (sheet) at the fixing nip portion when the fixing motor speed is $N_1$, and $V_{f2}$ is a conveying speed when the fixing motor speed is $N_2$, the loop amount can be expressed by $(t_3-t_2)(V_{f1}-V_{f2})$ (oblique portion in the drawing). $V_{f1}$ is substantially equivalent to the conveying speed $V_b$ of the transferring material at the secondary transfer nip portion, and satisfies $V_{f1}>V_{f2}$.

Even with the same loop amount, by changing the two parameters of $t_2$ and $V_{f2}$, a time to provide a predetermined loop amount can be changed.

Figure 10B:
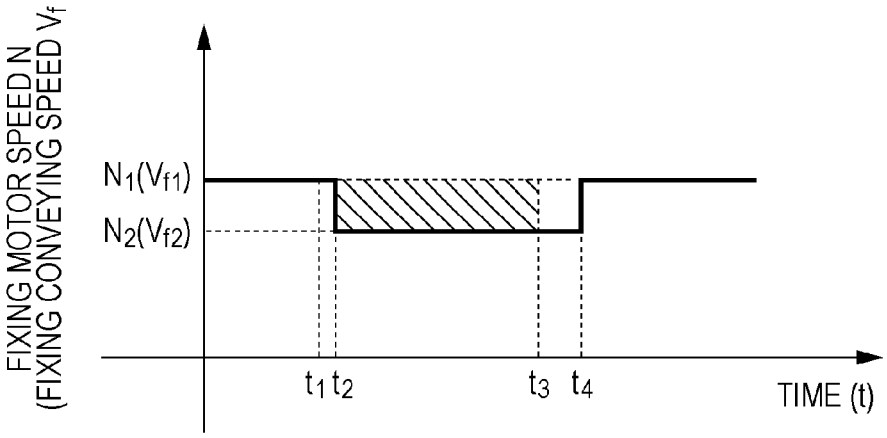

For example, as shown in FIG. 10B, a loop is formed slowly ($t_2$ is decreased and $V_{f2}$ is increased). With this configuration in FIG. 10B, a change rate of the pushing force on the intermediate transfer belt 51 due to the loop formation is decreased, and the variation in load applied to the intermediate transfer belt 51 can be decreased. $t_2$ can be changed within a range of $t_1 \leq t_2 < t_3$. Also, $V_{f2}$ can be changed within an allowable range for the torque of the fixing motor.

As described above, with this embodiment, even in the second image formation mode in which the number of support points for the intermediate transfer belt 51 is small, the variation in speed of the intermediate transfer belt occurring when the transferring material exits the secondary transfer nip portion can be suppressed, and hence an image with high image quality can be obtained.

Second Embodiment

In the first embodiment, the control is performed such that the loop amount of the sheet when the rear edge of the sheet has exited the T2 nip portion in the mono-color mode becomes larger than the loop amount in the full-color mode. Also, the control is performed such that, even in the same mode, the loop amount is increased more if the thickness of the sheet is small. In the second embodiment, a method of dealing with a change in temperature for the diameter of the heating rotary member 16 and the diameter of the pressure roller 15 will be described in addition to the configuration in the first embodiment.

The conveying speed for the transferring material at the fixing nip portion may vary because of expansion and contraction of the diameter of the pressure roller 15 and the diameter of the heating rotary member 16 due to a change in temperature. As a result, the loop amount of a loop formed at a position between the T2 nip portion and the fixing nip portion may vary.

Basically, design may be made such that a predetermined loop amount is provided when the rear edge of the sheet exits the T2 nip portion under a condition that the conveying speed at the fixing nip portion is highest (a condition that a loop likely becomes the smallest). However, the space for the sheet conveyance path from the secondary transfer nip portion to the fixing nip portion may be limited. With this limitation, if the variation in loop amount due to a change in temperature of the diameter of the pressure roller 15 and the diameter of the heating rotary member 16 is not allowable, the fixing motor speed has to be changed to an optimal speed in accordance with the temperature, to stabilize the loop amount to be formed.

Figure 12:
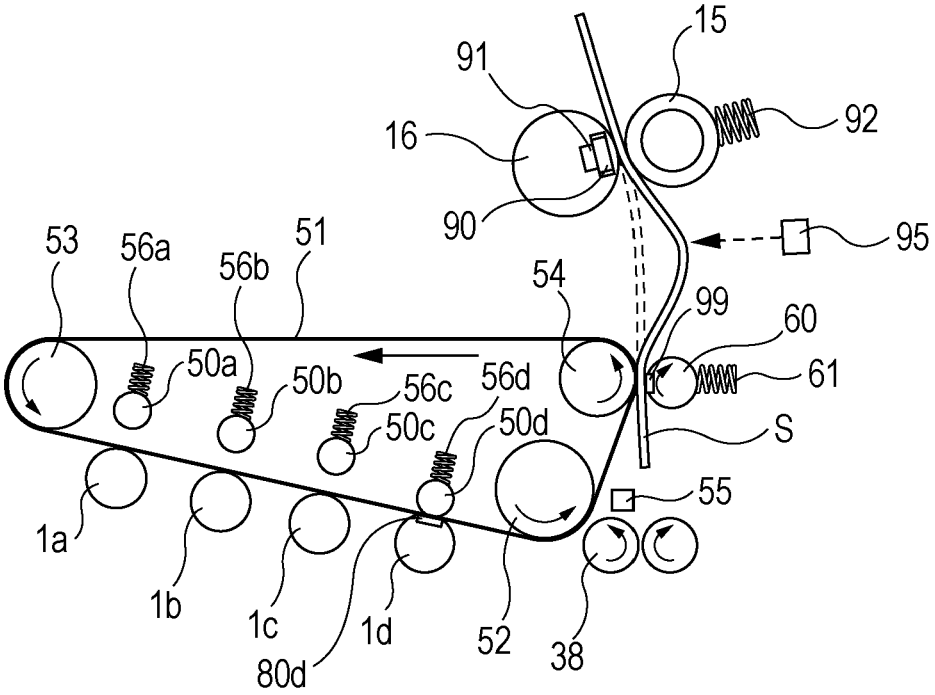
FIG. 12 is an illustration schematically showing an intermediate transfer nip portion according to a second embodiment.

For example, referring to FIG. 12, a non-contact sensor 95 (loop amount detecting member) may be provided. The non-contact sensor 95 measures a sheet position. The non-contact sensor 95 measures the formed loop amount, and thus, the CPU in the control portion (not shown) causes the fixing motor speed to be changed so that the loop amount becomes constant (predetermined loop amount) on the basis of the measurement result (detection result).

Alternatively, a temperature sensor (not shown), which is a temperature detecting member, may be attached to the pressure roller 15. In this case, the temperature sensor (not shown) detects the temperature of the pressure roller 15, and the speed control circuit controls the fixing motor on the basis of the detection result of the temperature detecting member so that the loop amount to be formed becomes constant.

Alternatively, the thermistor 91 that monitors the temperature of the heater 90 of the heating rotary member 16 may be used as the temperature detecting member. The CPU in the control portion (not shown) turns off the heater 90 at a predetermined timing, the thermistor 91 monitors a decrease rate per unit time of the heater 90, and the temperature of the pressure roller 15 is estimated, to obtain the conveying speed at the fixing nip portion. The speed control circuit may change the fixing motor speed in accordance with the obtained conveying speed. Accordingly, the loop amount to be formed becomes constant.

In this embodiment, the variation in speed of the intermediate transfer belt can be suppressed, the variation which occurs when the sheet has exited the secondary transfer nip portion, and hence an image with high image quality can be obtained.

With the present invention, the variation in speed of the intermediate transfer belt can be decreased, the variation which is generated when the transferring material exits the secondary transfer nip portion defined by the secondary transfer member and the intermediate transfer belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

REFERENCE SIGNS LIST

1*a* to 1*d* photosensitive drum (image bearing member)
50*a* to 50*d* primary transfer roller
51 intermediate transfer belt
52 driving roller
53 tension roller
54 secondary transfer opposite roller
55 sheet thickness sensor
56 compression spring
60 secondary transfer roller
61 compression spring
80*a* to 80*d* primary transfer nip portion
99 secondary transfer nip portion

The invention claimed is:

1. An image forming apparatus comprising:

a rotatable intermediate transfer belt;

a plurality of image bearing members arranged in a rotation direction of the intermediate transfer belt and configured to bear toner images;

a plurality of primary transfer members respectively facing the plurality of image bearing members with the intermediate transfer belt interposed therebetween and being capable of defining primary transfer nip portions with the corresponding image bearing members facing the primary transfer members;

a secondary transfer member configured to transfer the toner images transferred on the intermediate transfer belt by the primary transfer members onto a transferring material at a secondary transfer nip portion;

a fixing portion configured to fix the toner images transferred by the secondary transfer member to the transferring material at a fixing nip portion;

a driving roller configured to move the intermediate transfer belt and arranged downstream to all primary transfer nip portions and upstream of the secondary transfer nip portion in a moving direction of the intermediate transfer belt; and a speed control unit configured to control a conveying speed of the transferring material, wherein the speed control unit is capable of controlling a loop amount of a loop of the transferring material at a position between the secondary transfer nip portion and the fixing nip portion, and wherein, when a first loop amount is created in a case where a primary transfer portion is defined only by a primary transfer member facing a most downstream image bearing member in the moving direction of the intermediate transfer member and a second loop amount is created in a case where primary transfer nip portions are defined by all of the image bearing members and all of the primary transfer members, the first loop amount is larger than the second loop amount.

2. The image forming apparatus according to claim 1, further comprising:

a pair of rollers configured to convey the transferring material toward the secondary transfer nip portion, wherein the speed control unit starts to increase the loop amount of the transferring material when the rear edge of the transferring material is passing a nip portion of the pair of rollers.

3. The image forming apparatus according to claim 2, wherein the image bearing member located at the most downstream side bears a black toner image.

4. The image forming apparatus according to claim 1, wherein the loop of the transferring material formed at the position between the secondary transfer nip portion and the fixing nip portion is formed because the speed control unit controls the conveying speed of the transferring material at the fixing nip portion to be lower than the conveying speed of the transferring material at the secondary transfer nip portion.

5. The image forming apparatus according to claim 1, wherein loop formation of the transferring material at the position between the secondary transfer nip portion and the fixing nip portion is started under the control of the speed control unit before a rear edge of the transferring material exits the secondary transfer nip portion, and the loop formation is ended under the control of the speed control unit after the rear edge of the transferring material exits the secondary transfer nip portion.

6. The image forming apparatus according to claim 1, further comprising:

a thickness detecting member configured to detect a thickness of the transferring material, wherein if the thickness of the transferring material detected by the thickness detecting member is small, the speed control unit controls the conveying speed of the transferring material at the secondary transfer nip portion and the conveying speed of the transferring material at the fixing nip portion such that the loop amount of the loop of the transferring material at the position between the secondary transfer nip portion and the fixing nip portion is increased as compared with a case in which the thickness is large.

7. The image forming apparatus according to claim 1, further comprising:

a temperature detecting member configured to detect a temperature of the fixing portion, wherein the speed control unit controls the conveying speed of the transferring material at the secondary transfer nip portion and the conveying speed of the transferring material at the fixing nip portion such that the loop amount of the loop of the transferring material at the position between the secondary transfer nip portion and the fixing nip portion becomes a predetermined loop amount in accordance with the temperature of the fixing portion detected by the temperature detecting member.

8. The image forming apparatus according to claim 1, wherein, in a case where the toner images are secondarily transferred onto transferring materials continuously conveyed, a distance between the primary transfer nip portion to be formed in the image formation mode and the secondary transfer nip portion in a conveyance direction of the intermediate transfer belt is shorter than a distance between transferring materials being conveyed.

9. The image forming apparatus according to claim 1, wherein the plurality of image bearing members are arranged below the intermediate transfer belt.

10. The image forming apparatus according to claim 1, wherein the speed control unit controls the conveying speed of the transferring material such that a loop amount of the transferring material when a rear edge of the transferring material passes the secondary transfer nip portion is larger than a loop amount of the transferring material when a front edge of the transferring material passes the fixing portion.

11. The image forming apparatus according to claim 1, further comprising a gear made of resin configured to drive the driving roller.

* * * * *